US005814933A

United States Patent [19]

Iwata et al.

[11] Patent Number: 5,814,933

[45] Date of Patent: Sep. 29, 1998

[54] CATHODE RAY TUBE HAVING AN IMPROVED FRONT PANEL

[75] Inventors: Tsuyoshi Iwata; Mutsumi Maehara; Hiroshi Yoshioka, all of Mobara, Japan

[73] Assignee: Hitachi, Ltd., Tokyo, Japan

[21] Appl. No.: 810,731

[22] Filed: Mar. 4, 1997

[30] Foreign Application Priority Data

Mar. 4, 1996 [JP] Japan ..... 8-046332

[51] Int. Cl.[6] ..... H01J 31/00

[52] U.S. Cl. ..... 313/477 R; 220/3.1 A; 220/3.1 R

[58] Field of Search ..... 313/477 R; 220/2.1 A, 220/2.1 R, 2.3 A

[56] References Cited

U.S. PATENT DOCUMENTS

| | | | |
|---|---|---|---|
| 4,537,321 | 8/1985 | Tokita | 313/2.1 A |
| 4,537,322 | 8/1985 | Okada et al. | 313/2.1 A |
| 5,386,174 | 1/1995 | Ishii | 313/477 R |
| 5,568,011 | 10/1996 | Raghland, Jr. et al. | 313/477 R |

*Primary Examiner*—Ashok Patel
*Attorney, Agent, or Firm*—Antonelli, Terry, Stout & Kraus, LLP

[57] ABSTRACT

A color cathode ray tube includes a front panel having a phosphor screen deposited on its interior surface. A contour of the interior surface is configured such that a radius Rx of a surface curvature of sections parallel to a horizontal axis and a radius Ry of a surface curvature of sections parallel to a vertical axis of the front panel are substantially constant, respectively, within a screen area of the phosphor screen.

12 Claims, 3 Drawing Sheets

CATHODE RAY TUBE HAVING AN IMPROVED FRONT PANEL

BACKGROUND OF THE INVENTION

The present invention relates to a color cathode ray tube, and particularly to a cathode ray tube having improved display characteristics by configuring the contour of the interior surface of the front panel of the panel portion such that the surface curvatures of sections parallel to its horizontal and vertical axes of the front panel are substantially constant, respectively, within the screen area.

The glass envelope of a color cathode ray tube comprises a large-diameter panel portion constituting a front portion of the cathode ray tube, a small-diameter and long neck portion constituting a rear portion and a funnel portion connecting the panel and neck portions. A front panel of the panel portion displays images on a phosphor film deposited on its inner surface during operation of the cathode ray tube and is slightly curved to provide improved viewing of the displayed images and to maintain the glass envelope strength and other purposes.

Concerning the contour of front panels of the panel portion of the glass envelope of usual prior art color cathode ray tubes, color cathode ray tubes for display terminals have spherical exterior and interior surfaces and color cathode ray tubes for TV receivers have nonspherical exterior and interior surfaces.

The prior art color cathodes ray tube for display use can prevent third- and higher-order pincushion distortions from occurring in images displayed on the phosphor screen because of both their interior and exterior surfaces of the front panel being spherical, but there is a problem that implosion preventing characteristics of the glass envelope deteriorate to some extent.

The prior art color cathode ray tubes for TV use are excellent in implosion preventing characteristics of the glass envelope because of both their interior and exterior surfaces being nonsherical, but there is the problem of third- and higher-order pincushion distortions of images occurring on the phosphor screen formed on the front panel.

SUMMARY OF THE INVENTION

An object of the present invention is to solve the above-described problems of the prior art, and to provide a cathode ray tube capable of preventing third- and higher-order pincushion distortions from occurring in the displayed image and at the same time maintaining satisfactory implosion preventing characteristics.

To achieve the above object, according to one preferred embodiment of the present invention, the contour of the interior surface of the front panel of the panel portion of the glass envelope is configured such that the surface curvatures of sections parallel to its horizontal and vertical axes of the front panel are substantially constant, respectively, within the screen area, and the contour of the exterior surface of the front panel is formed spherical or nonspherical depending upon intended use of the color cathode ray tube.

With this configuration of the color cathode ray tube, third- and higher-order pincushion distortions are prevented from occurring in images displayed on the phosphor screen formed on and conformed in shape to the interior surface of the front panel, and the implosion preventing characteristics are satisfactory.

BRIEF DESCRIPTION OF THE DRAWINGS

In the drawings, which form an integral part of the specification and are to be read in conjunction therewith, and in which like reference numerals designate similar components throughout the figures; and in which.

DETAILED DESCRIPTION OF THE PREFERRED EMBODIMENTS

In one embodiment of the present invention, the contour of the interior surface of the front panel of the panel portion of the glass envelope constituting a color cathode ray tube is configured such that the surface curvatures of sections parallel to the horizontal axis and the vertical axis of the front panel are substantially constant, respectively, within the screen area. The contour of the exterior surface of the front panel is formed to be spherical or nonspherical depending upon intended use of the color cathode ray tube. The surface curvatures of sections parallel to the horizontal axis and the vertical axes of the front panel shall be hereinafter called the curvature parallel to the horizontal axis (or x axis) and the vertical axis (or y axis) of the front panel, respectively. The curvature parallel to the horizontal axis (or x axis) and the curvature parallel to the vertical axis (or y axis) of the front panel differ from each other irrespective of intended use of the color cathode ray tube.

On the interior surface of the front panel of the panel portion of the above embodiment, the horizontal direction and the vertical direction are taken as the x axis and the y axis, respectively, and a direction perpendicular to the x and y axes, or a tube axis, is taken as the z axis.

Cutting of the interior surface of the front panel by a plurality of planes parallel to the x-z plane containing the horizontal axis and the tube axis produces plane curves of one constant curvature, cutting of the interior surface of the front panel by a plurality of planes parallel to the y-z plane containing the vertical axis and the tube axis produces plane curves of another constant curvature, consequently no third- and higher-order pincushion distortions occur in images displayed on the phosphor screen deposited on the interior of the front panel.

In the above embodiment, the curvature parallel to the horizontal axis and the curvature parallel to the vertical axis of the front panel differ from each other, and the contour of the exterior surface of the front panel is formed to be spherical or nonspherical, and these improve implosion preventing characteristics.

Further in the above embodiment, the contour of the exterior surface of the front panel is formed to be nonspherical or spherical depending upon its intended use, like conventional color cathode ray tubes, the existing manufacturing equipment for conventional glass envelopes can be used to manufacture the glass envelopes of the present invention, the time required for developing new equipment to cope with changes in shape of the front panel can be shortened, and increase in the manufacturing cost of color cathode ray tubes can be minimized.

The embodiments of the present invention will be explained in detail hereunder with reference to the accompanying drawings.

Figure 1:
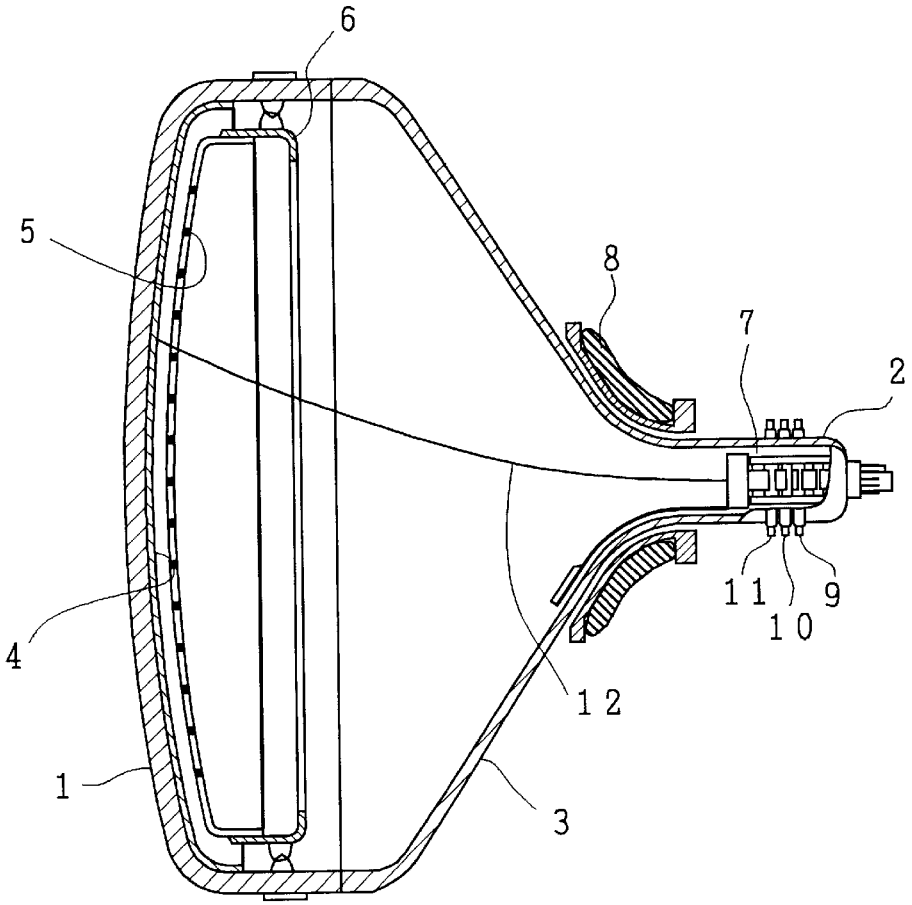
FIG. 1 is a schematic sectional view of a color cathode ray tube in which one embodiment of the present invention is incorporated.

FIG. 1 is a schematic sectional view of a color cathode ray tube in which one embodiment of the present invention is incorporated. In FIG. 1, reference numeral 1 indicates a panel portion, 2 a funnel portion, 3 a neck portion, 4 a phosphor screen, 5 a shadow mask, 6 a mask frame, 7 an electron gun, 8 a deflection yoke, 9 a purity adjustment magnet, 10, 11 static convergence adjustment magnets and 12 an electron beam. The glass envelope of a color cathode ray tube comprises the panel portion 1 disposed at a front end thereof, the neck portion 3 housing the electron gun 7 and the funnel portion 2 connecting the panel portion 1 and the neck portion 3. The panel portion 1 has a phosphor screen 4 deposited on its inner surface and a shadow mask disposed a short distance from the phosphor screen 4. The shadow mask 5 is held in predetermined spaced relationship adjacent to the phosphor screen 4 by the mask frame 6 and the mask frame 6 is fixed inside the panel portion 1. A magnetic shield (not shown) is disposed inside the junction of the panel portion 1 and the funnel portion 2, and the deflection yoke 8 is mounted around the junction 3 of the funnel portion 2 and the neck portion 3. The purity adjustment magnet 9, and the static convergence adjustment magnets 10, 11 are juxtaposed around the neck portion 3. Each of the three electron beams 12 (only one beam is shown in FIG. 1 for simplicity) emitted from the electron gun is deflected by the deflection yoke 8 in a predetermined direction, passes through the shadow mask 5 and impinges upon picture elements of the corresponding color of the phosphor screen 4.

The operation, that is, displaying of images, of the cathode ray tube of this configuration is the same as that of prior art cathode ray tubes and explanation of displaying images by a cathode ray tube is omitted in this specification.

Figure 2:
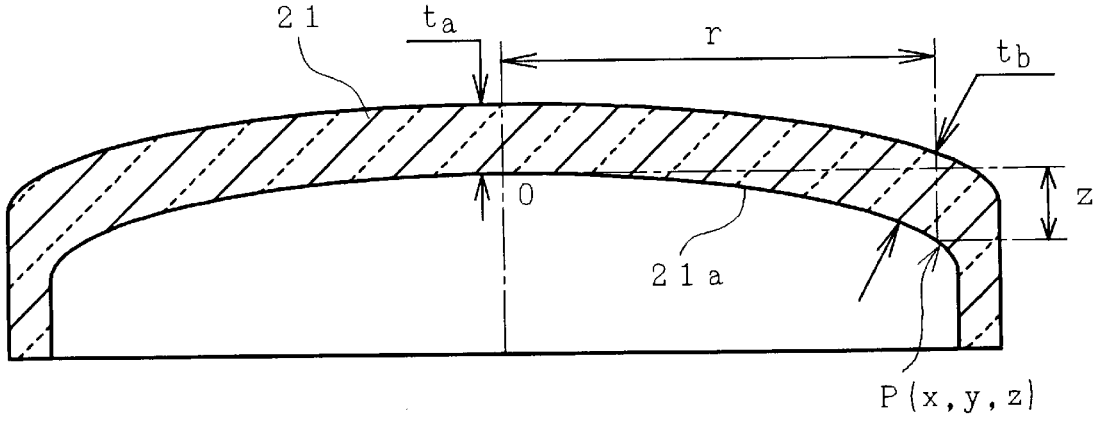
FIGS. 2 is a transverse cross-sectional view of the color cathode ray tube taken along the horizontal axis of the front panel of the glass envelope of FIG. 1.
Figure 3A:
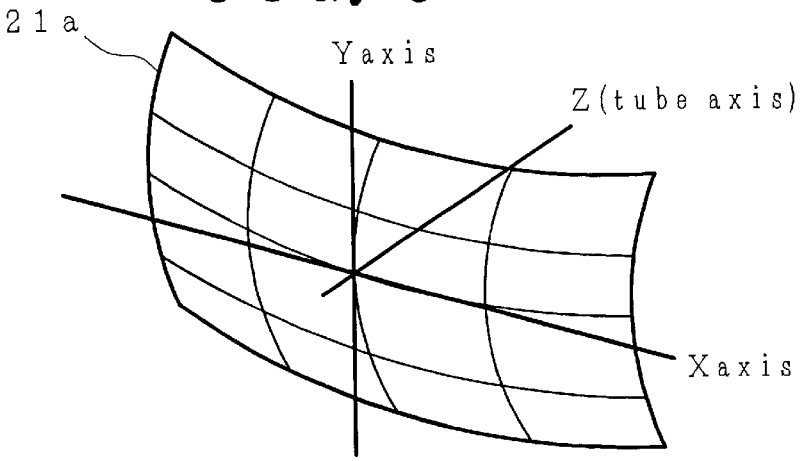
FIG. 3A is an illustration of the interior surface of the front panel of the glass envelope of the color cathode ray tube of FIG. 1 indicated by contours of sections parallel to the horizontal axis (x axis) and vertical axis (y axis) of the front panel.
Figure 3B:
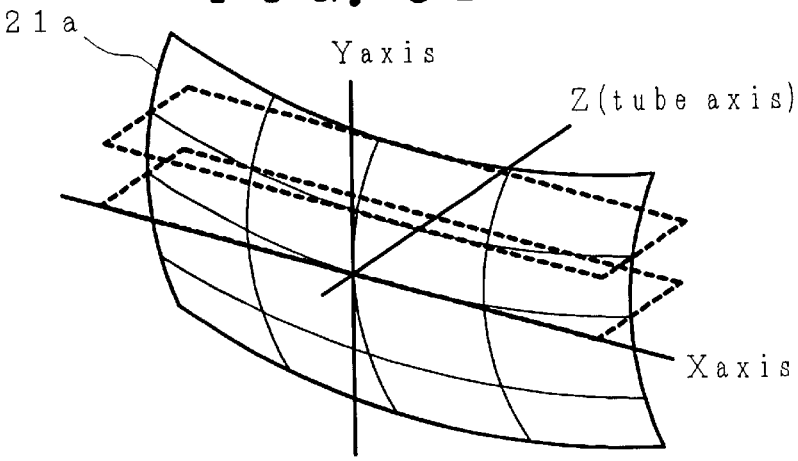
FIG. 3B is a modification of FIG. 3A having a plane parallel to the plane containing the horizontal axis (x axis) and the tube axis (z axis) added to each contour of sections parallel to the horizontal axis (x axis) and FIG. 3C is another modification of FIG. 3A having a plane parallel to the plane containing the vertical axis (y axis) and the tube axis (z axis) added to each contour of sections parallel to the vertical axis (y axis).
Figure 3C:
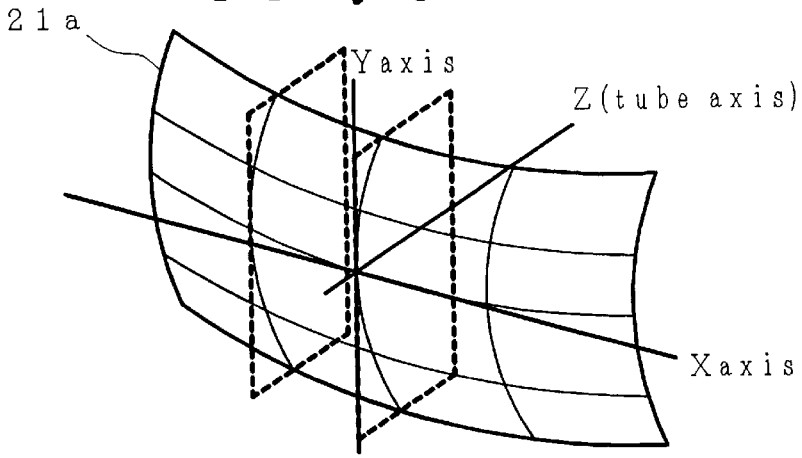

FIG. 2 is a cross-section of an example of the front panel of the glass envelope of the color cathode ray tube of FIG. 1 taken along its horizontal axis. FIGS. 3A to 3C are illustrations of the interior surface of the front panel of the glass envelope of the color cathode ray tube of FIG. 1, FIG. 3A indicates the inner surface of the front panel by contours of sections parallel to the horizontal axis (x axis) and vertical axis (y axis) of the front panel, respectively, FIG. 3B is a modification of FIG. 3A having a plane parallel to the plane containing the horizontal axis (x axis) and the tube axis (z axis) added to each contour of sections parallel to the horizontal axis (x axis) to facilitate understanding of FIG. 3A, and FIG. 3C is another modification of FIG. 3A having a plane parallel to the plane containing the vertical axis (y axis) and the tube axis (z axis) added to each contour of sections parallel to the vertical axis (y axis) to facilitate understanding of FIG. 3A.

As indicated in FIG. 2, the cross-section of the front panel 21 is configured such that its thickness "tb" at its peripheral portions is greater than its thickness "ta" at its center.

The rectangular coordinate axes in FIGS. 2 and 3A to 3C are drawn so that the origin O is at the center of the interior surface 21*a* of the front panel 21, and the x and y coincide with the horizontal and vertical axes of the front panel 21, respectively, and the z axis coincides with the axis of the cathode ray tube. A distance r of a point P (x, y, z) on the interior surface 21*a* from its center is $$r = \sqrt{x^2 + y^2} \quad . \tag{1}$$

The coordinate z of the point P indicates the inner surface 21*a* of the front panel 21 indicates the inner surface 21*a* of the front panel 21 and is $$z = Rx - \sqrt{R^2x - x^2} + Ry - \sqrt{R^2y - y^2} \tag{2}$$

where the curvatures parallel to the x and y axes of the front panel 21 are expressed by radii Rx and Ry, respectively.

Figure 4:
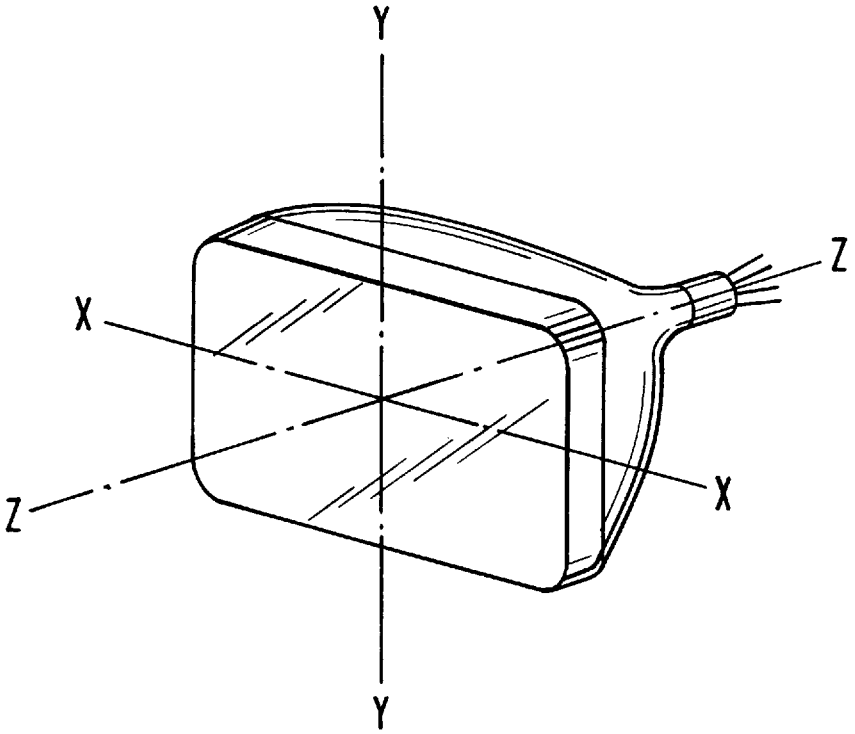
FIG. 4 is a diagram of a nonspherical front panel of an embodiment of the present invention.

In a preferred embodiment of the present invention, a 59-cm diagonal, 90° deflection cathode ray tube has a front panel having an interior surface expressed by the equation (2), Rx of 1889.2 mm and Ry of 1180.0 mm, and a nonspherical exterior surface as indicated by $$z = a1x^2 + a2x^4 + b1y^2 + b2y^4 + c1x^2y^2 + c2x^4y^2 + c3x^2y^4 + c4x^4y^4$$

where $a1 = 0.2548189 \times 10^{-3}$ $a2 = 0.2325611 \times 10^{-10}$ $b1 = 0.3723351 \times 10^{-3}$ $b2 = 0.1622961 \times 10^{-10}$ $c1 = 0.5174547 \times 10^{-10}$ $c2 = -0.1012704 \times 10^{-14}$ $c3 = -0.1121805 \times 10^{-14}$ $c4 = 0.3168829 \times 10^{-19}$ FIG. 4 is illustrative of an non-spherical exterior front-panel surface embodiment of the present invention.

In another preferred embodiment of the present invention, a 59-cm diagonal, 90° deflection cathode ray tube has a front panel having an interior surface expressed by the equation (2), Rx of 1889.2 mm and Ry of 1180.0 mm, and a spherical exterior surface.

The practical ranges of Rx and Ry are shown below.

$400\ \text{mm} \leqq Rx \leqq 3600\ \text{mm}$ $400\ \text{mm} \leqq Ry \leqq 3600\ \text{mm}$ In the embodiments of the present invention, as shown in FIGS. 3A–3C, the inner surface of the front panel is indicated by contours of sections parallel to the horizontal axis (x axis) and vertical axis (y axis) of the front panel, respectively, FIG. 3B shows all the plane curves produced by cutting the interior surface of the front panel by a plurality of planes parallel to the x-z plane have one constant curvature and FIG. 3C shows all the plane curves produced by cutting the interior surface of the front panel by a plurality of planes parallel to the y-z plane have one constant curvature.

In the above embodiments, as a result of the fact that each of the curvatures parallel to the horizontal and vertical axes of the front panel has a constant value within a useful display screen area, no third- and higher-order pincushion distortions occur in the images formed on the phosphor screen deposited on the interior surface of the front panel.

In the above embodiments, the curvatures parallel to the horizontal and vertical axes of the front panel differ from each other, and the contour of the exterior surface of the front panel is formed to be spherical or nonspherical depending upon application, and these improve implosion preventing characteristics.

As described above, cathode ray tubes in accordance with the present invention have a front panel of the glass envelope configured such that each of the curvatures parallel to the horizontal (x) and vertical (y) axes of the front panel has a constant value, and has an advantage that no third- and higher-order pincushion distortions occur in the images formed on the phosphor screen deposited on the interior surface of the front panel. When the curvatures parallel to the horizontal and vertical axes of the front panel are designed to differ from each other, and the contour of the exterior surface of the front panel is formed to be spherical or nonspherical, implosion preventing characteristics are improved in the present invention. When the exterior surfaces of the front panel of the glass envelope are formed to be spherical and nonspherical for color cathode ray display tubes and color cathode ray TV tubes, respectively, like those of prior color cathode ray tubes, the existing manufacturing equipment for conventional glass envelopes can be used to manufacture the glass envelopes of the present invention, the time required for developing new equipment to cope with changes in shape of the front panel can be shortened, and increase in the manufacturing cost of color cathode ray tubes can be minimized.

What is claimed is:

1. A color cathode ray tube including an evacuated glass envelope comprising a panel portion, a funnel portion and a neck portion, said panel portion including a front panel having a phosphor screen deposited on an interior surface thereof, a contour of said interior surface being configured such that a radius Rx of a surface curvature of sections parallel to a horizontal axis and a radius Ry of a surface curvature of sections parallel to a vertical axis of said front panel are substantially constant, respectively, within a screen area of said phosphor screen.

2. A color cathode ray tube according to claim 1, wherein said Rx and Ry satisfy following inequalities $400\ \text{mm} \leqq Rx \leqq 3600\ \text{mm}$ $400\ \text{mm} \leqq Ry \leqq 3600\ \text{mm}$.

3. A color cathode ray tube according to claim 1, wherein said Rx and Ry differ from each other.

4. A color cathode ray tube according to claim 2, wherein said Rx and Ry differ from each other.

5. A color cathode ray tube according to claim 1, wherein an exterior surface of said front panel is spherical.

6. A color cathode ray tube according to claim 2, wherein an exterior surface of said front panel is spherical.

7. A color cathode ray tube according to claim 3, wherein an exterior surface of said front panel is spherical.

8. A color cathode ray tube according to claim 4, wherein an exterior surface of said front panel is spherical.

9. A color cathode ray tube according to claim 1, wherein an exterior surface of said front panel is nonspherical.

10. A color cathode ray tube according to claim 2, wherein an exterior surface of said front panel is nonspherical.

11. A color cathode ray tube according to claim 3, wherein an exterior surface of said front panel is nonspherical.

12. A color cathode ray tube according to claim 4, wherein an exterior surface of said front panel is nonspherical.

* * * * *